US008893737B2

(12) United States Patent
Yang

(10) Patent No.: US 8,893,737 B2
(45) Date of Patent: Nov. 25, 2014

(54) TENT SKELETON AND TENT

(71) Applicant: Zhejiang Hengfeng Top Leisure Co., Ltd., Zhejiang (CN)

(72) Inventor: Baoqing Yang, Hangzhou (CN)

(73) Assignee: Zhenjiang Hengfeng Top Leisure Co., Ltd., DeQing County, Zhejiang ( * ) Notice: Subject to any disclaimer, the term of this patent is extended or adjusted under 35 U.S.C. 154(b) by 0 days.

(21) Appl. No.: 13/832,991

(22) Filed: Mar. 15, 2013

(65) Prior Publication Data

US 2014/0174491 A1 Jun. 26, 2014

(30) Foreign Application Priority Data

Dec. 25, 2012 (CN) ..... 2012 2 0728766 U

(51) Int. Cl.
*E04H 15/48* (2006.01)
*E04H 15/58* (2006.01)

(52) U.S. Cl.
CPC ..... *E04H 15/48* (2013.01)
USPC ..... 135/140; 135/121; 135/131; 135/144; 403/109.2

(58) Field of Classification Search
USPC ..... 135/14–147, 151–154, 158–159, 905; 403/170–17, 217, 109.2, 109.3, 293, 403/297; 52/74, 93.1
See application file for complete search history.

(56) References Cited

U.S. PATENT DOCUMENTS

| | | | | | |
|---|---|---|---|---|---|
| 2,182,283 | A * | 12/1939 | Curtis | 135/136 |
| 4,285,355 | A * | 8/1981 | Lundblade | 135/147 |
| 6,381,767 | B1 * | 5/2002 | Brashears | 4/498 |
| 6,814,094 | B1 * | 11/2004 | Barber | 135/119 |
| 7,367,348 | B2 * | 5/2008 | Tsai et al. | 135/145 |
| 8,215,326 | B2 * | 7/2012 | Park et al. | 135/145 |
| 8,616,226 | B2 * | 12/2013 | Ma et al. | 135/145 |
| 2006/0174929 | A1 * | 8/2006 | Tseng | 135/159 |
| 2007/0051397 | A1 * | 3/2007 | Choi | 135/131 |
| 2007/0221262 | A1 * | 9/2007 | Tsai et al. | 135/145 |
| 2010/0275962 | A1 * | 11/2010 | Park et al. | 135/122 |
| 2011/0073148 | A1 * | 3/2011 | Choi | 135/145 |

FOREIGN PATENT DOCUMENTS

| | | | | |
|---|---|---|---|---|
| JP | 09112080 | A * | 4/1997 | E04H 15/34 |
| JP | 2007023697 | A * | 2/2007 | E04H 15/58 |
| JP | 2007132097 | A * | 5/2007 | E04H 15/50 |

* cited by examiner

*Primary Examiner* — Winnie Yip
(74) *Attorney, Agent, or Firm* — Fitch, Even, Tabin & Flannery LLP

(57) ABSTRACT

A tent skeleton including a plurality of foot poles, a plurality of eave poles that are articulated at their end portions and are radially arranged, an eave connecting device and a locating device for fixing the foot pole. The eave connecting device includes a connecting member body and an eave connecting member articulated to the connecting member body, the connecting member body is fixedly arranged on an end of the foot pole. The eave pole includes an outer tube, an inner tube and a retractable locking device. The outer tube is fixedly connected to the eave connecting member; the inner tube is slidably sleeved in the outer tube; the retractable locking device is arranged between the outer tube and the inner tube. A tent is further disclosed.

12 Claims, 6 Drawing Sheets

TENT SKELETON AND TENT

CROSS-REFERENCE TO RELATED APPLICATION

This application claims the benefit of priority to Chinese patent application No. 201220728766.8 titled "TENT SKELETON AND TENT", filed with the Chinese State Intellectual Property Office on Dec. 25, 2012. The entire disclosure thereof is incorporated herein by reference.

FIELD OF THE INVENTION

The present application relates to the technical field of a tent, and more particularly to a tent skeleton and a tent.

BACKGROUND OF THE INVENTION

With the popularity of outdoor recreation, the tent, which serves as a necessary tool in outdoor recreation activity, is attracting more and more attention from consumers.

In order to enlarge the sun-shading area of the tent, it is required to enlarge the area of the roof of the tent. To this end, those skilled in the art have designed a tent which has an eave.

FIG. 1 is a conventional product showing a structure of an eave portion of a tent. Two fiber poles 03 are connected to the top end of a tent foot pole 02 via a top three-way connecting member 01. An inclined fiber pole mounting groove 010 is provided on the top portion of the top three-way connecting member 01, and the inner diameter of the fiber pole mounting groove 010 is slightly larger than that of the fiber pole 03. A rectangular opening 011 is provided in the fiber pole mounting groove 010, and the two fiber poles 03 are connected to each other via an elastic rope 04.

When using the tent, firstly, the top three-way connecting member 01 is mounted on the top of the tent foot pole 02. Then the two fiber poles 03 are drawn towards the opposite sides such that the elastic rope 04 is elongated to be able to pass through the opening 011. And then, the elastic rope 04 is placed in the fiber pole mounting groove 010, and the ends of the two fiber poles 03 are also inserted in the fiber pole mounting groove 010. After the above steps are finished, the assembling of the tent skeleton is accomplished. And at last, the tarpaulin is fixed on the tent skeleton.

In the above tent, the fiber pole 03 is detachably connected to the tent foot pole 02 via the top three-way connecting member 01. To unfold the skeleton of the tent, the user needs to assemble the components into one body, while to fold the skeleton of the tent, the user needs to disassemble the various components and store them separately. This kind of detachable structure results in a tent that is complicated to use.

In view of this, there is an urgent demand for those skilled in the art to provide a tent provided with an eave, such that the user does not need to assemble or disassemble the tent via the process of unfolding or folding, thereby simplifying the usage of the tent.

SUMMARY OF THE INVENTION

In view of this, it is provided according to the present application a tent skeleton and a tent, which omit assembling and disassembling operations in the process of unfolding or folding the tent, and thus simplifies the usage of the tent.

In order to achieve the above object, it is provided according to the present application the following technical solutions:

a tent skeleton including a plurality of foot poles, a plurality of eave poles which are articulated at end portions thereof and are radially arranged, an eave connecting device and a locating device for fixing the foot poles;

the eave connecting device includes a connecting member body and an eave connecting member articulated to the connecting member body, and the connecting member body is fixedly arranged on an end portion of the foot pole; and the eave pole includes an outer tube, an inner tube and a retractable locking device, the outer tube is fixedly connected to the eave connecting member, the inner tube is slidably sleeved in the outer tube, and the retractable locking device is arranged between the outer tube and the inner tube for locking the length of the eave pole.

Preferably, in the above tent skeleton, the eave connecting member is provided with a mounting hole for connecting with the eave pole, and a diameter of the mounting hole is not less than that of the eave pole.

Preferably, in the above tent skeleton, a side wall of the mounting hole is provided with a locking hole, the eave connecting member further includes a nut and a lock screw arranged in the locking hole for locking the eave pole.

Preferably, in the above tent skeleton, one end of the mounting hole is provided with an external thread segment, the external thread segment being provided with a contraction slot; and the eave connecting member further includes an internal thread sleeve detachably arranged on the external thread segment.

Preferably, in the above tent skeleton, the tent skeleton further includes a top connecting assembly, and each of the eave poles is articulated to the top connecting assembly via an end portion thereof.

Preferably, in the above tent skeleton, the locating device includes an outer pin locating device and a retractable rod group articulated to the outer pin locating device, the outer pin locating device includes:

a locating body provided with a foot pole hole and a pin locating hole, an axis of the foot pole hole is perpendicular to that of the pin locating hole, and an inner surface of the pin locating hole is provided with a track groove, the track groove being communicated to an outer surface of the locating body, and a length direction of the track groove being parallel to the axis of the pin locating hole;

a pin disposed in the pin locating hole, the pin is provided with a track post, and the track post has a length larger than a distance from the inner surface of the pin locating hole to the outer surface of the locating body and is slidably disposed in the track groove;

a cam knob including a knob and two connecting pieces fixedly provided on the knob, wherein opposite surfaces of the connecting pieces are provided with position-limiting grooves, an end face of each connecting piece away from the knob is provided with a curved surface portion having a curvature radius gradually increased, and ends of the track post are disposed or provided in the position-limiting grooves; and a spring disposed in the pin locating hole and located between the locating body and the pin.

Preferably, in the above tent skeleton, the retractable rod group includes at least one connecting rod group. The connecting rod group includes two connecting rods connected to each other via an articulating shaft disposed at middle positions of the connecting rods. One end of the connecting rod being articulated to an end of a connecting rod located at a different side in another connecting rod group, and the other end being articulated to the connecting member body or the locating body.

Preferably, in the above tent skeleton, the tent skeleton further includes an auxiliary supporting pole. One end of the auxiliary supporting pole is articulated to the locating body, and the other end thereof is articulated to a sliding sleeve slidably arranged on the eave pole.

The present application provides a tent skeleton including a plurality of foot poles, a plurality of eave poles articulated at end portions thereof and radially arranged, an eave connecting device and a locating device for fixing the foot poles. The eave connecting device includes a connecting member body and an eave connecting member articulated to the connecting member body. The connecting member body is fixedly arranged on the end of the foot pole, and the eave connecting member is detachably fixed to the eave pole. The eave pole includes an outer tube, an inner tube and a retractable locking device. The outer tube is fixedly connected to the eave connecting member. The inner tube is slidably sleeved in the outer tube, and the retractable locking device is arranged between the outer tube and the inner tube for locking the length of the eave pole.

When unfolding the tent skeleton according to the present application, firstly, the foot poles are located by the locating device. Then, the inner tube is drawn out from the outer tube. Finally, the inner tube drawn out is locked by the locking device to lock the length of the eave pole, thus finishing the unfolding of the tent skeleton. When folding the tent skeleton, firstly, the locking device is unlocked. Then the eave inner tube is retracted into the outer tube. Then the locating device is unlocked, and finally the tent skeleton can be folded.

Compared with the existing tent skeleton, the tent skeleton according to the present application is more convenient to use since the user does not need to assemble or disassemble the tent skeleton in the process of unfolding or folding the tent.

A tent includes a tent skeleton and a tarpaulin arranged on the tent skeleton, the tent skeleton is the above tent skeleton.

The present application also provides a tent which includes the above tent skeleton and a tarpaulin arranged on the tent skeleton. The user does not need to assemble or disassemble the tent skeleton in the process of using the tent according to the present application, and thus the usage thereof is easier.

BRIEF DESCRIPTION OF THE DRAWINGS

In order to clearly describe technical solutions of embodiments according to the present application or those in the prior art, accompanying drawings used in the description of the embodiments or the prior art will be introduced briefly hereinafter. The accompanying drawings in the following description are only some of the embodiments according to the present application, and those skilled in the art, based on these drawings, may obtain other drawings without any creative work.

Figure 1:
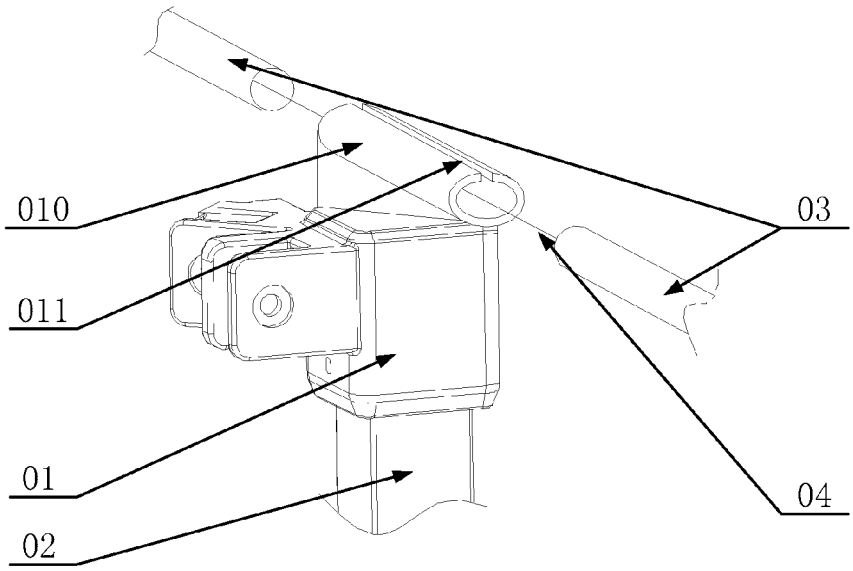
FIG. 1 Prior art
FIG. 1 is a structural schematic view of an eave portion of an existing tent.

Reference numerals in FIGS. 1 to 12:

| | |
|---|---|
| 01. top three-way connecting member, | 02. tent foot pole, |
| 03. fiber pole, | 04. elastic rope, |
| 010. fiber pole mounting groove, | 011. opening, |
| 1. foot pole, | 2. eave pole, |
| 3. eave connecting device, | 4. locating device, |
| 5. top connecting assembly, | 6. auxiliary supporting pole, |
| 7. sliding sleeve, | 20. outer tube, |
| 21. inner tube, | 22. locking device, |
| 30. connecting member body, | 31. eave connecting member, |
| 32. mounting hole, | 33. locking hole, |
| 34. lock screw, | 35. external thread segment, |
| 36. contraction slot, | 37. internal thread sleeve, |
| 40. locating body, | 41. pin, |
| 42. cam knob, | 43. spring, |
| 44. connecting rod group | |
| 400. foot pole hole, | 401. pin locating hole, |
| 402. track groove, | 410. track post, |
| 420. knob, | 421. connecting piece, |
| 422. position-limiting groove, | 423. curved surface portion. |

DETAILED DESCRIPTION OF THE INVENTION

It is provided according to embodiments of the present application a tent skeleton which simplifies the usage of the tent since users do not need to assemble or disassemble the tent in the process of unfolding or folding the tent.

Hereinafter, technical solutions in the embodiments of the present application will be described clearly and completely in conjunction with the drawings in the embodiments of the present application. The embodiments to be described are only a part, rather than all, of the embodiments of the present application. Based on the embodiments in the present application, all of the other embodiments, made by those skilled in the art without any creative efforts, fall into the protection scope of the present application.

Figure 2:
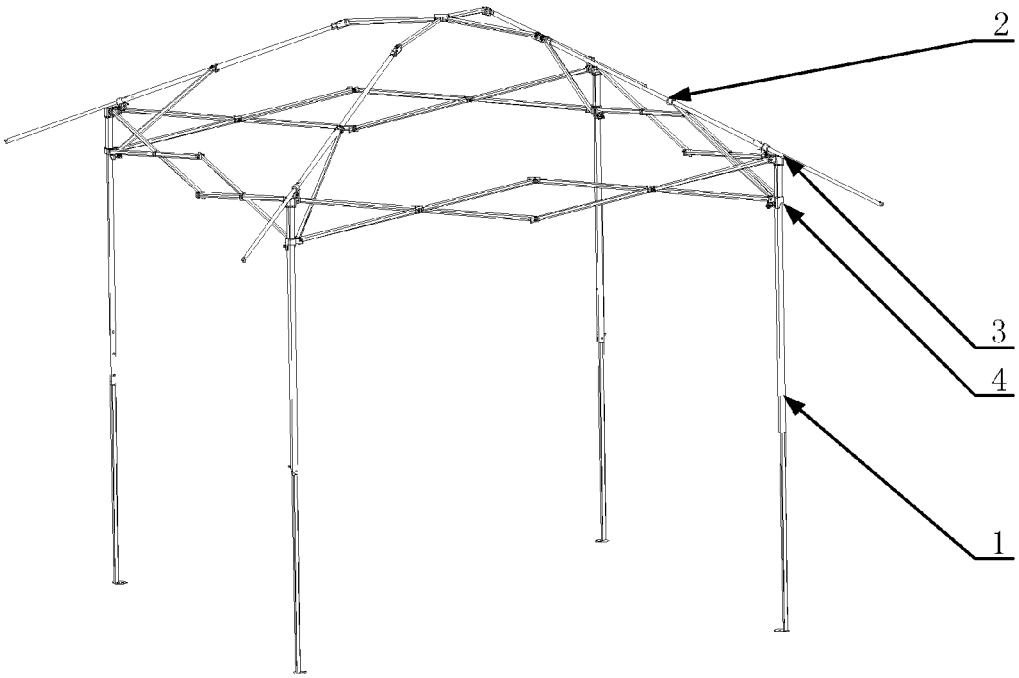
FIG. 2 is a structural schematic view of a tent skeleton according to an embodiment of the present application.
Figure 3:
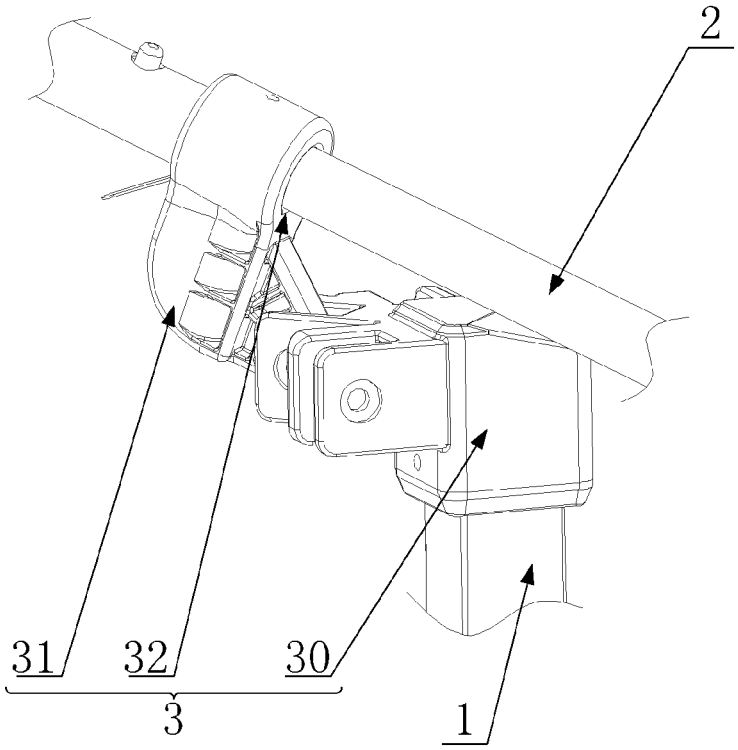
FIG. 3 is a structural schematic view of an eave portion of a tent skeleton according to an embodiment of the present application.
Figure 4:
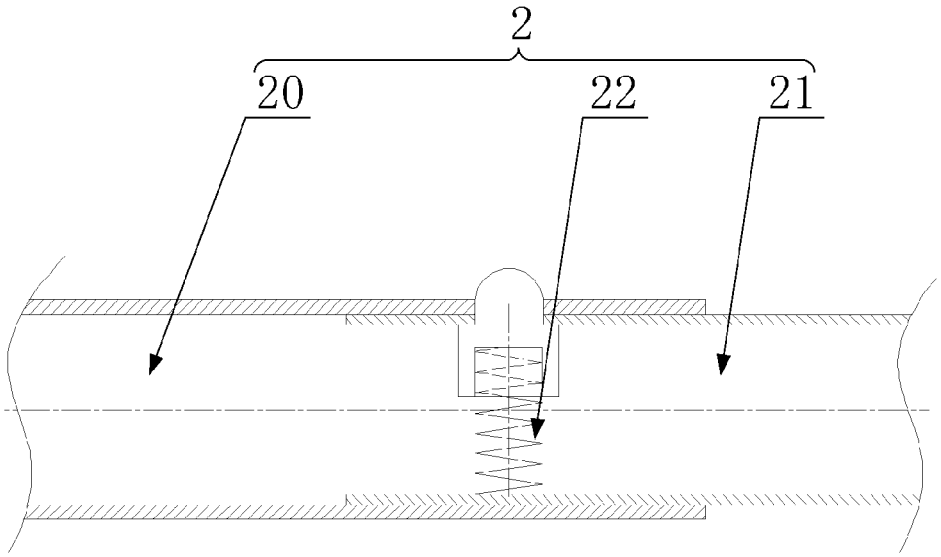
FIG. 4 is a structural schematic view of a telescopic eave pole.

Referring to FIGS. 2 to 4, the tent skeleton according to embodiments of the present application includes foot poles 1, eave poles 2, eave connecting devices 3 and locating devices 4.

The eave poles 2 are articulated at their end portions and are arranged radially. The eave connecting device 3 includes a connecting member body 30 and an eave connecting member 31 that are articulatedly connected. The connecting member body 30 is fixedly arranged on an end portion of the foot pole 1. The eave connecting member 31 is detachably connected to the eave pole. The locating device 4 is configured to fix the foot pole 1.

The eave pole 2 includes an outer tube 20, an inner tube 21 and a locking device 22. The outer tube 20 is fixedly connected to the eave connecting member 31. The inner tube 21 is slidably sleeved to the outer tube 20 and is located in the outer tube 20. The locking device 22 is arranged between the outer tube 20 and the inner tube 21 for locking relative positions of the outer tube 20 and the inner tube 21, thereby locking the length of the eave pole 2.

As can be seen, when unfolding the tent, the length of the eave pole 2 can be elongated by pulling the inner tube 21 outwards, thereby obtaining a larger sun-shading area. When folding the tent, the inner tube 21 can be retracted into the outer tube 20, which will not increase the size of the tent after being folded.

When unfolding the tent skeleton according to the present application, firstly, positions of the foot poles 1 are fixed through the locating devices 4. Then, the inner tubes 21 are pulled outwards from the outer tubes 20. Finally, the inner tubes 21 extended out are locked by the locking devices 22 to thereby lock the lengths of the eave poles 2. In this way, the unfolding of the tent skeleton is completed. When folding the tent skeleton, firstly, the locking devices 22 are unlocked, then the inner tubes 21 are retracted into the outer tubes 20, and then the locating devices 4 are unlocked, and finally the tent skeleton can be folded.

Compared with the existing tent skeleton, it is easier to use the tent skeleton according to the present application since the user does not need to assemble or disassemble the tent skeleton in the process of unfolding or folding the tent skeleton.

It can be understood by those skilled in the art that the locking device 22 may have various structures, for example, each of the outer tube 20 and the inner tube 21 is provided with a locating hole, and an elastic nail having an elastic returning member arranged in the locating holes, thereby the length of the eave pole 2 can be locked, detailed structures of which will not be described herein.

In the tent skeleton according to the above embodiments, as shown in FIG. 3, the eave connecting member 31 is provided with a mounting hole 32 having a diameter equal to or larger than that of the eave pole 2. By inserting the eave pole 2 into the mounting hole 32, the eave pole 2 can be slidably connected to the mounting hole 32.

Figure 5:
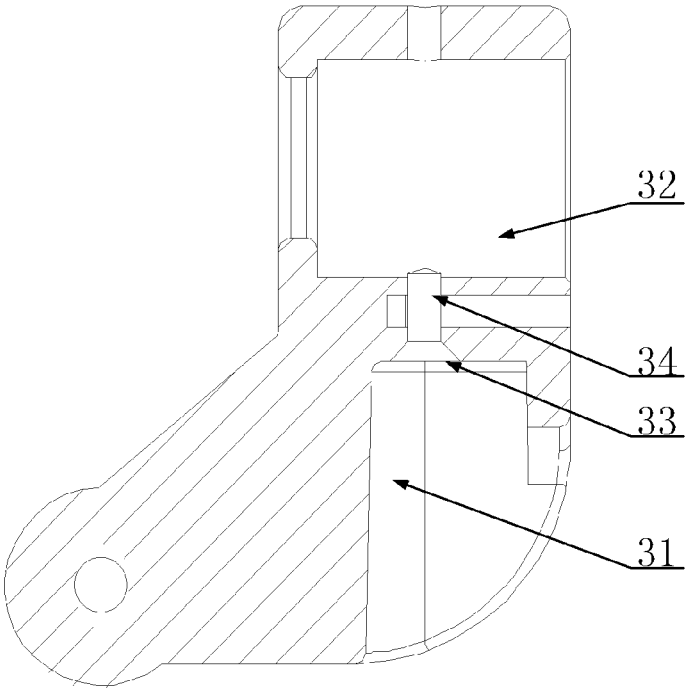
FIG. 5 is a structural schematic view of an eave connecting member.

In order that the eave pole 2 is fixedly connected to the eave connecting member 31 after the skeleton is unfolded, in the tent skeleton according to the above embodiment, referring to FIG. 5, the side wall of the mounting hole 32 is provided with a locking hole 33, and a lock screw 34 is provided in the locking hole 33. After the eave pole 2 is inserted into the mounting hole 32 and is adjusted in place, the eave pole 2 can be fixedly connected by tightening the lock screw 34, thereby preventing the eave pole 2 from sliding in the mounting hole 32.

Further, the lock screw 34 is sleeved with a nut to prevent the lock screw 34 from falling off when the lock screw 34 is loosened.

Figure 6:
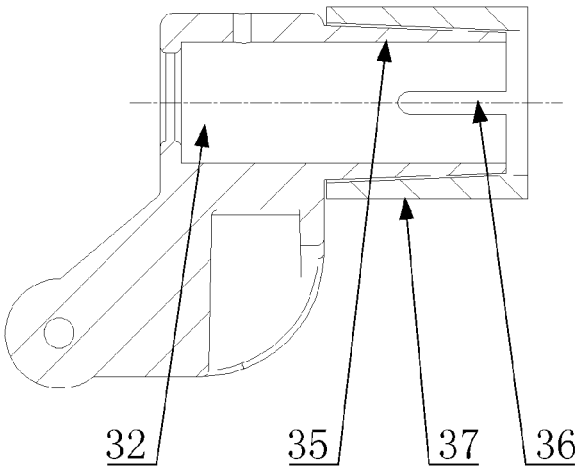
FIG. 6 is a structural schematic view of an eave connecting member according to another embodiment of the present application.

In the tent skeleton according to the above embodiment, the eave pole 2 is fixed via the lock screw 34. In another embodiment of the present application, the same function can be achieved by providing an external thread segment that can be contracted. Referring to FIG. 6, one end of the mounting hole 32 is provided with an external thread segment 35, the external thread segment 35 is provided with a contraction slot 36, and an internal thread sleeve 37 is detachably provided on the external thread segment 35.

After the eave pole 2 is inserted into the mounting hole 32, the external thread segment 35 can be contracted by tightening the internal thread sleeve 37. The external thread segment 35 will be contracted towards the central axis thereof because of the contraction slot 36 until it is pressed against the surface of the eave pole 2. The eave pole 2 cannot be moved easily since there is a large static friction force between the eave pole 2 and the external thread segment 35, thereby achieving the fixing of the eave pole 2.

It can be conceived that, in the tent skeleton according to the above embodiments, there may be one or a plurality of contraction slots 36. The shape of the contraction slot 36 may be a straight slot parallel to the external thread segment 35 or a helical slot. Preferably, the contraction slot 36 includes two straight slots symmetrically provided on the external thread segment 35.

Figure 7:
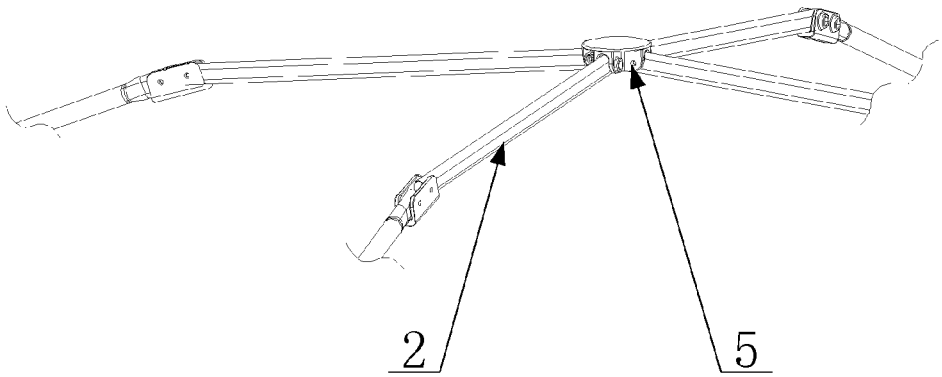
FIG. 7 is a partial schematic view of a top portion of a tent skeleton according to an embodiment of the present application.
Figure 8:
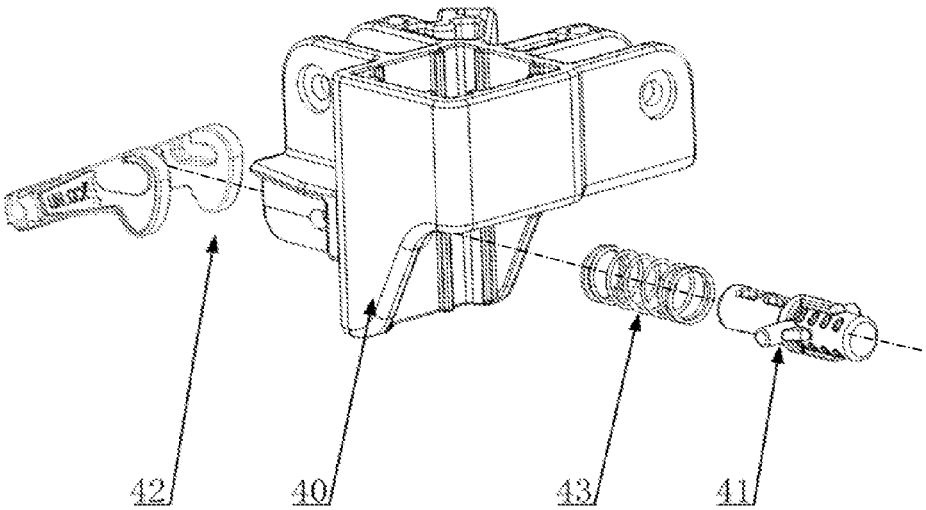
FIG. 8 is a structural schematic view of an outer pin locating device.
Figure 9:
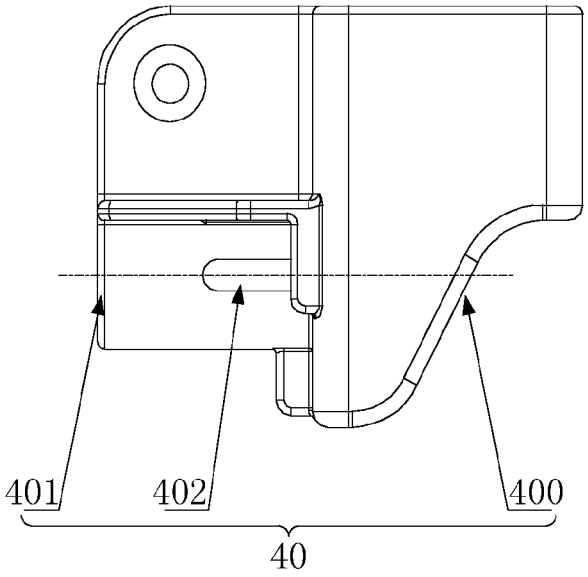
FIG. 9 is a structural schematic view of a locating body.
Figure 10:
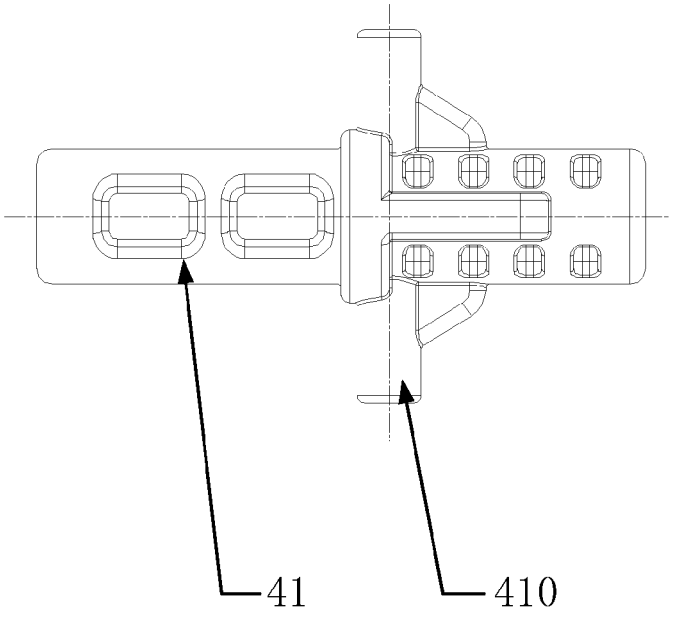
FIG. 10 is a structural schematic view of a pin.
Figure 11:
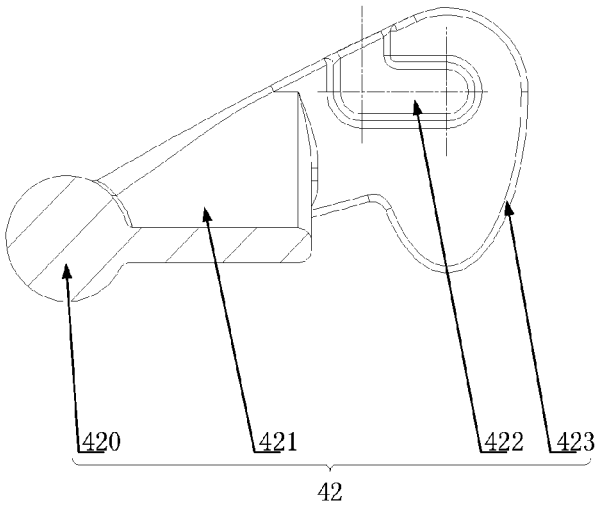
FIG. 11 is a structural schematic view of a cam knob.

In the tent skeleton according to the above embodiment, the eave poles 2 are articulated via a top connecting assembly 5. Referring to FIG. 7, the top connecting assembly 5 is provided with hinged joints, and one end of each eave pole 2 is connected with one corresponding hinged joint, thereby the eave poles 2 are radially arranged.

Meanwhile, the tent after being folded may have a large size if the eave pole 2 is configured to be long, which is inconvenient to carry; while the tent after being unfolded may have a limited size if the length of the eave pole 2 is configured to be short, resulting in a small sun-shading area. In view of this, as shown in FIG. 7, the eave pole 2 includes an eave segment and an articulated segment articulated with the eave segment. When being unfolded, the articulated segment and the eave segment constitute an integral eave pole which has a large length, thereby the tent can provide a large sun-shading area; and after being folded, the length of the eave pole is less than or equal to that of the articulated segment or that of the eave segment, which is convenient to carry.

In the tent skeleton according to the above embodiment, the locating device 4 includes an outer pin locating device and a retractable rod group articulatedly connected with the outer pin locating device.

As shown in FIGS. 8 to 11, the outer pin locating device includes a locating body 40, a pin 41, a cam knob 42 and a spring 43.

The locating body 40 is provided with a foot pole hole 400 and a pin locating hole 401, and the axis of the foot pole hole 400 is perpendicular to that of the pin locating hole 401. A track groove 402 is provided on the inner surface of the pin locating hole 401, the length direction of the track groove 402 is parallel to the axial direction of the pin locating hole 401, and the track groove 402 communicates the outer surface of the locating body with the inner surface of the pin locating hole 401.

The pin 41 is disposed in the pin locating hole 401. The pin 41 is provided with a track post 410. The track post 410 is slidably disposed in the track groove 402, and the length of the track post 410 is larger than the distance from the inner surface of the pin locating hole 401 to the outer surface of the locating body 40.

The cam knob 42 includes a knob 402 and two connecting pieces 421 fixedly provided on the knob 420. Opposite surfaces of the two connecting pieces 421 are provided with position-limiting grooves 422, and two ends of the track post 410 are respectively snapped into the position-limiting grooves 422, thereby achieving an articulated connection between the cam knob 42 and the pin 41. Meanwhile, a curved surface portion 423 is provided on the end surface of the end of the connecting piece 421 away from the knob 420, and the curvature radius of the curved surface portion is gradually increased. The cam knob 42 rotates with the track post 410 which is snapped into the position-limiting grooves 422. When being rotated, the cam knob 42 is rotated against the rotational surface of the curved surface portion 423, thereby achieving the telescopic function of the pin 41. When the pin 41 is snapped into the hole for fixing the foot poles 1, the pin 41 is fixed.

The spring 43 is disposed in the pin locating hole 401 and is located between the locating body 40 and the pin 41. When the cam knob 42 is forced to rotate, the pin 41 is moved and the spring 43 is compressed. Without any external force, the pin 41 may return under the elastic potential energy stored in the spring 3.

The retractable rod group includes at least one connecting rod group 44. The connecting rod group 44 includes two connecting rods articulated to each other, and an articulating shaft is provided at middle positions of the connecting rods. In each connecting rod group 44, to each of the connecting rods, one end of the connecting rod is articulated to the end of the connecting rod located at different side in another connecting rod group 44, and the other end thereof is articulated to the connecting member body 30 or the locating body 40.

When assembling the above outer pin locating device, firstly, the spring 43 is placed in the pin locating hole 401. Then, the pin 41 is inserted in the pin locating hole 401, and the track post 410 on the pin 41 is located in the track grooves 402. Finally, the pin is pressed into the pin locating hole 401 under an external force such that the track post 410 is embedded and retained in the position-limiting grooves 422 on the cam knob 42, such that the pin 41 is articulated with the cam knob 42.

When being used, the cam knob 42 is turned towards the direction in which the curvature radius of the curved surface portion 423 is larger, meanwhile, the pin 41 articulated with the cam knob 42 is moved by rotating the cam knob 42, and thus the locating action is removed. After the cam knob 42 is released, the pin 41 returns back under the action of the spring 43, driving the cam knob 42 to turn towards the direction in which the curvature radius is smaller. The pin after returning back performs the locating function again.

When unfolding the tent skeleton according to the present embodiment, firstly, the outer pin locating device is released such that distances between respective foot poles 1 can be adjusted. Then, ends of the eave poles 2 articulated to one another are held upwards such that the top of the tent skeleton is raised upwards. During the process, the distance between the foot poles 1 is firstly increased and then is decreased. Then, the foot poles 1 are properly located and are locked by the outer pin locating device. Finally, the inner tube 21 in the eave pole 2 is pulled outwards, thereby finishing the unfolding of the tent skeleton.

When unfolding the tent skeleton according to the present embodiment, firstly, the outer pin locating device is driven to move up along the foot pole 1 by the connecting rod group 44 at the side. During the upward movement of the outer pin locating device, the pin thereof is automatically inserted in the locating hole on the foot pole 1. Then, the inner tube 21 of the eave pole 2 is drawn out and is locked by the locking device 22, thereby finishing the unfolding of the tent skeleton.

To fold the tent skeleton, the user only needs to perform the above steps in reverse order.

It can be found that, in the tent skeleton according to the embodiments of the present application, the user only needs to perform such operations as unfolding, locking, unlocking or folding on respective components in the processes of unfolding and folding the tent skeleton. The user does not need to assemble or disassemble the components, which simplifies the usage of the tent.

It can be conceived that, in the tent skeleton according to the present application, the locating device 4 may be implemented in various manners. For example, the tent skeleton may be fixedly connected to the ground by ordinary tent pegs, and may be implemented to have the following structure.

The locating device 4 includes a retractable rod that can be locked and the outer pin locating device in the above embodiment. The outer pin locating device is sleeved on the foot pole 1. One end of the retractable rod is articulated to the outer pin locating device, and the other end thereof is articulated to an adjacent foot pole 1 or another outer pin locating device which is sleeved on the adjacent foot pole 1.

After the tent skeleton is unfolded, an end of the retractable rod may be located by the outer pin locating device, and the length of the retractable rod may be locked by the locking device on the retractable rod, thereby adjacent foot poles 1 are located.

Figure 12:
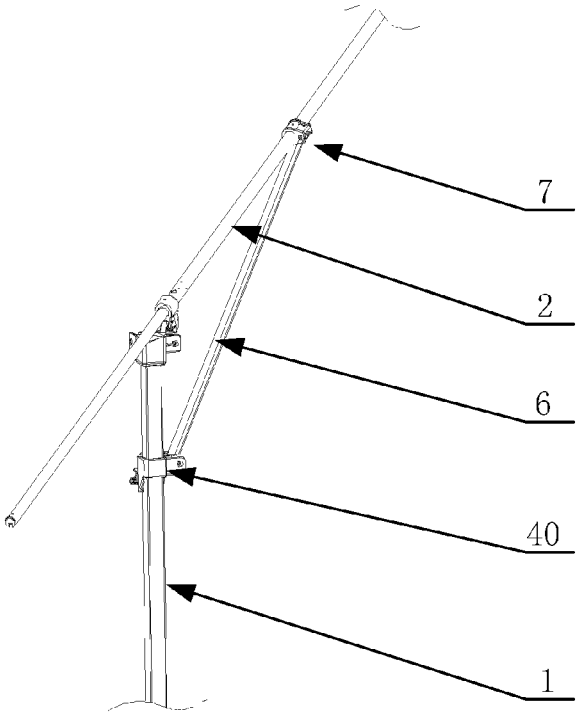
FIG. 12 is a structural schematic view of an auxiliary supporting pole of a tent skeleton according to an embodiment of the present application.

Preferably, the tent skeleton according to the above embodiments may further include an auxiliary supporting pole 6 for helping to support the eave pole 2. Referring to FIG. 12, one end of the auxiliary supporting pole 6 is articulated to the locating body 40, and the other end thereof is articulated with a sliding sleeve 7 which is sleeved on the eave pole 2.

It can be seen that, in the unfolded tent skeleton, in a case that the eave pole 2 is subjected to a downward pressure, a part of the pressure will be transferred to the foot pole 1 via the auxiliary supporting pole 6, thereby protecting the eave pole 2 from being broken due to an excessively centralized pressure.

It is further provided according to the present application a tent which includes the above tent skeleton and a tarpaulin arranged on the tent skeleton. When using the tent according to the present application, the user does not need to assemble or disassemble the tent skeleton, thus it is convenient to use the tent.

The embodiments are described herein in a progressive manner. The description of each of the embodiments is mainly focused on differences between the embodiment and the other embodiments, and for those having the same or similar components, references may be made among these embodiments with respect to the same or similar components.

Based on the description of the above embodiments, those skilled in the art can carry out or use the present application. It is apparent for those skilled in the art to make many modifications to these embodiments. The general principle defined herein may be applied to other embodiments without departing from the spirit or scope of the present application. Therefore, the present application is not limited to the embodiments illustrated herein, but is defined by the broadest scope consistent with the principle and novel features disclosed herein.

The invention claimed is:

1. A tent skeleton comprising a plurality of foot poles, a plurality of eave poles which are articulated at end portions thereof and are radially arranged, an eave connecting device and a locating device for fixing the foot poles, wherein the eave connecting device comprises a connecting member body and an eave connecting member articulated to the connecting member body, and the connecting member body is fixedly provided on an end of the foot pole; and the eave pole comprises an outer tube, an inner tube and a retractable locking device, wherein the outer tube is fixedly connected to the eave connecting member, the inner tube is slidably sleeved in the outer tube, and the retractable locking device is provided between the outer tube and the inner tube for locking the length of the eave pole, wherein the eave connecting member is provided with a mounting hole for connecting with the eave pole, and a diameter of the mounting hole is not less than that of the eave pole; and wherein an external thread segment is provided at one end of the mounting hole, the external thread segment being provided with a contraction slot; and the eave connecting member further comprises an internal thread sleeve detachably provided on the external thread segment.

2. The tent skeleton according to claim 1, wherein a side wall of the mounting hole is provided with a locking hole and a nut, and a lock screw is further provided in the locking hole for locking the eave pole.

3. The tent skeleton according to claim 1, further comprising a top connecting assembly, and each of the eave poles is articulated to the top connecting assembly via an end portion thereof.

4. The tent skeleton according to claim 1, wherein the locating device comprises an outer pin locating device and a retractable rod group articulated to the outer pin locating device, wherein the outer pin locating device comprises:

a locating body provided with a foot pole hole and a pin locating hole, wherein an axis of the foot pole hole is perpendicular to that of the pin locating hole, and an inner surface of the pin locating hole is provided with a track groove, the track groove being communicated to an outer surface of the locating body, and a length direction of the track groove being parallel to the axis of the pin locating hole;

a pin provided in the pin locating hole, the pin is provided with a track post, and the track post has a length larger than a distance from the inner surface of the pin locating hole to the outer surface of the locating body and is slidably provided in the track groove;

a cam knob comprising a knob and two connecting pieces fixedly provided on the knob, wherein opposite surfaces of the connecting pieces are provided with position-limiting grooves, an end face of each connecting piece away from the knob is provided with a curved surface portion having a curvature radius gradually increased, and ends of the track post are provided in the position-limiting grooves; and a spring provided in the pin locating hole and located between the locating body and the pin.

5. The tent skeleton according to claim 4, wherein the retractable rod group comprises at least one connecting rod group, and wherein the connecting rod group comprises two connecting rods connected to each other via an articulating shaft provided at middle positions of the connecting rods, one end of the connecting rod being articulated to an end of a connecting rod located at a different side in another connecting rod group, and the other end being articulated to the connecting member body or the locating body.

6. The tent skeleton according to claim 4, further comprising an auxiliary supporting pole, and one end of the auxiliary supporting pole is articulated to the locating body, and the other thereof is articulated to a sliding sleeve slidably provided on the eave pole.

7. A tent comprising a tent skeleton and a tarpaulin arranged on the tent skeleton, wherein the tent skeleton is the tent skeleton according to claim 1.

8. A tent comprising a tent skeleton and a tarpaulin arranged on the tent skeleton, wherein the tent skeleton is the tent skeleton according to claim 2.

9. A tent comprising a tent skeleton and a tarpaulin arranged on the tent skeleton, wherein the tent skeleton is the tent skeleton according to claim 3.

10. A tent comprising a tent skeleton and a tarpaulin arranged on the tent skeleton, wherein the tent skeleton is the tent skeleton according to claim 4.

11. A tent comprising a tent skeleton and a tarpaulin arranged on the tent skeleton, wherein the tent skeleton is the tent skeleton according to claim 5.

12. A tent comprising a tent skeleton and a tarpaulin arranged on the tent skeleton, wherein the tent skeleton is the tent skeleton according to claim 6.

* * * * *